US011195482B2

(12) United States Patent
Huang

(10) Patent No.: US 11,195,482 B2
(45) Date of Patent: Dec. 7, 2021

(54) DISPLAY DEVICE AND DRIVING METHOD THEREOF

(71) Applicant: HKC CORPORATION LIMITED, Guangdong (CN)

(72) Inventor: Beizhou Huang, Guangdong (CN)

(73) Assignee: HKC CORPORATION LIMITED, Guangdong (CN)

( * ) Notice: Subject to any disclaimer, the term of this patent is extended or adjusted under 35 U.S.C. 154(b) by 538 days.

(21) Appl. No.: 16/315,288

(22) PCT Filed: Mar. 28, 2018

(86) PCT No.: PCT/CN2018/080908
§ 371 (c)(1),
(2) Date: Jan. 4, 2019

(87) PCT Pub. No.: WO2019/080446
PCT Pub. Date: May 2, 2019

(65) Prior Publication Data

US 2021/0335292 A1 Oct. 28, 2021

(30) Foreign Application Priority Data

Oct. 25, 2017 (CN) ..... 201711007565.2

(51) Int. Cl.
*G09G 3/36* (2006.01)

(52) U.S. Cl.
CPC ... *G09G 3/3607* (2013.01); *G09G 2300/0452* (2013.01)

(58) Field of Classification Search
None
See application file for complete search history.

(56) References Cited

U.S. PATENT DOCUMENTS

2008/0297463 A1 12/2008 Tsuru et al.
2013/0271501 A1 10/2013 Teng-Chieh
2014/0043376 A1 2/2014 Zhang et al.
(Continued)

FOREIGN PATENT DOCUMENTS

CN 101231832 A 7/2008
CN 102254535 A 11/2011
(Continued)

OTHER PUBLICATIONS

International Search Report for Application No. PCT/CN2018/080908 dated Aug. 1, 2018, 11 pages.

*Primary Examiner* — Parul H Gupta
(74) *Attorney, Agent, or Firm* — Seyfarth Shaw LLP

(57) ABSTRACT

A display device and a driving method thereof are disclosed, the driving method includes: setting average values of a first component, a second component, and a third component of a first frame display image to be equal to a second average value, and setting the average values of both the first component and the third component of a second frame display image to be equal to a third average value, and setting the average value of the second component to be equal to zero; adjusting lightness of a backlight module according to the average values of the first component, the second component, and the third component corresponding to the original display image, the first frame display image, and the second frame display image.

12 Claims, 6 Drawing Sheets

(56) References Cited

U.S. PATENT DOCUMENTS

| | | | | |
|---|---|---|---|---|
| 2020/0066217 | A1* | 2/2020 | Kang | G09G 3/3607 |
| 2020/0074944 | A1* | 3/2020 | Kang | G09G 3/3607 |
| 2021/0020118 | A1* | 1/2021 | Kang | G09G 3/3413 |
| 2021/0020120 | A1* | 1/2021 | Kang | G09G 3/3413 |
| 2021/0090511 | A1* | 3/2021 | Kang | G09G 3/342 |

FOREIGN PATENT DOCUMENTS

| | | | |
|---|---|---|---|
| CN | 102800290 | A | 11/2012 |
| CN | 106782375 | A | 5/2017 |
| CN | 106782377 | A | 5/2017 |
| CN | 107564490 | A | 1/2018 |
| GN | 106652950 | A | 5/2017 |
| WO | 2017175497 | A1 | 10/2017 |

* cited by examiner

DISPLAY DEVICE AND DRIVING METHOD THEREOF

CROSS REFERENCE TO RELATED APPLICATIONS

This is a National Stage application of, and claims priority to, PCT/CN2018/080908, filed Mar. 28, 2018, which claims priority to Chinese Patent Application No. 201711007565.2, filed Oct. 25, 2017, the disclosures of which are incorporated herein by reference in their entirety.

TECHNICAL FIELD

The present disclosure relates to the field of display technology, and more particularly relates to a display device and a driving method thereof.

BACKGROUND

Large-size liquid crystal displays mostly use a negative VA (Vertical Alignment) type liquid crystal or In-Plane Switching (IPS) liquid crystal technology. In a case of a large viewing angle, lightness of a pixel of the VA type liquid crystal display is rapidly saturated with a driving voltage, which causes a color shift of the liquid crystal display under the case of the large viewing angle to be more seriously, thereby affecting picture display quality of the liquid crystal display.

SUMMARY

In view of this, embodiments of the present disclosure provide a display device and a driving method thereof, which improve the color shift problem of a display panel in a case of a large viewing angle. Meanwhile, the problem that a difference of a grayscale lightness value ratio of a main hue component to other components between a case of a positive viewing angle and the large viewing angle for the low grayscale pixel is larger than that for a high grayscale pixel is improved, and energy consumption of the display device is reduced.

A driving method for a display device is provided in the embodiment of the present invention. A frame of an original display image of the display device includes at least one area, and each area includes a plurality of pixels. The driving method includes:

dividing the frame of the original display image in one of the area into a first frame display image and a second frame display image; wherein each pixel in the original display image, the first frame display image, and the second frame display image includes a component corresponding to a first color space, the component including a first component, a second component, and a third component;

obtaining a first average value, a second average value, and a third average value corresponding to the original display image in the area; wherein the first average value, the second average value, and the third average value are average values of the first component, the second component, and the third component corresponding to the original display image respectively, and the first average value is larger than the second average value, the second average value is larger than the third average value;

setting the average values of the first component, the second component, and the third component corresponding to the first frame display image in the area to be equal to the second average value, and setting the average values of both the first component and the third component corresponding to the second frame display image to be equal to the third average value, and setting the average value of the second component corresponding to the second frame display image to be equal to zero;

adjusting lightness of a backlight module according to the average values of the first component, the second component, and the third component corresponding to the original display image, the first frame display image, and the second frame display image in the area respectively;

obtaining a driving component corresponding to the pixel in the second frame display image, according to the lightness of the backlight module before and after adjustment, the component corresponding to the pixel in the original display image, and the driving component corresponding to the pixel in the first frame display image corresponding to the area; wherein the driving component corresponding to the pixel in the first frame display image is equal to a secondary largest component corresponding to the pixel in the original display image;

obtaining a hue angle value and a saturation in a second color space according to the first average value, the second average value, and the third average value;

setting the lightness of the backlight module corresponding to a set component corresponding to the pixel in the second frame display image according to the hue angle value and the saturation; wherein the set component corresponds to the secondary largest component corresponding to the pixel in the original display image; and driving a pixel unit in the display device to display according to the driving component corresponding to the pixel in the first frame display image and the driving component corresponding to the pixel in the second frame display image in the area.

Optionally, after obtaining a driving component corresponding to the pixel in the second frame display image, according to the lightness of the backlight module before and after adjustment, the component corresponding to the pixel in the original display image, and the driving component corresponding to the pixel in the first frame display image corresponding to the area, the method further includes:

determining a relationship between the obtained driving component corresponding to the pixel in the second frame display image in the area with zero and with the first component corresponding to the pixel in the original display image;

setting the driving component corresponding to the pixel in the second frame display image to be equal to zero, when the obtained driving component corresponding to the pixel in the second frame display image is smaller than zero; and setting the driving component corresponding to the pixel in the second frame display image to be equal to a maximum component corresponding to the pixel, when the obtained driving component corresponding to the pixel in the second frame display image is larger than the maximum component corresponding to the pixel.

Optionally, the backlight module includes a first backlight module, a second backlight module and a third backlight module, and the adjusting the lightness of a backlight module according to the average values of the first component, the second component, and the third component corresponding to the original display image, the first frame display image, and the second frame display image in the area respectively includes:

adjusting the lightness of the first backlight module according to a grayscale lightness value of the average value of the first component corresponding to the original display image, the first frame display image, and the second frame display image in the area respectively;

adjusting the lightness of the second backlight module according to the grayscale lightness value of the average value of the second component corresponding to the original display image, the first frame display image, and the second frame display image in the area respectively; and adjusting the lightness of the third backlight module according to the grayscale lightness value of the average value of the third component corresponding to the original display image, the first frame display image, and the second frame display image in the area respectively.

Optionally, the backlight module includes a first backlight module, a second backlight module and a third backlight module, wherein the obtaining a driving component corresponding to the pixel in the second frame display image, according to the lightness of the backlight module before and after adjustment, the component corresponding to the pixel in the original display image, and the driving component corresponding to the pixel in the first frame display image corresponding to the area includes:

obtaining the driving component corresponding to the first component of the pixel in the second frame display image according to the lightness of the first backlight module before and after adjustment, the first component corresponding to the pixel in the original display image, and the driving component corresponding to the pixel in the first frame display image corresponding to the area;

obtaining the driving component corresponding to the second component of the pixel in the second frame display image according to the lightness of the second backlight module before and after adjustment, the second component corresponding to the pixel in the original display image, and the driving component corresponding to the pixel in the first frame display image corresponding to the area; and obtaining the driving component corresponding to the third component of the pixel in the second frame display image according to the lightness of the third backlight module before and after adjustment, the third component corresponding to the pixel in the original display image, and the driving component corresponding to the pixel in the first frame display image corresponding to the area.

Optionally, the first color space is a red, green, and blue, RGB color space.

Optionally, the first component, the second component and the third component of the first color space correspond to a red component, a green component and a blue component in the RGB color space respectively.

Optionally, the second color space is an LCH color space.

Optionally, the display device is a liquid crystal display device.

A display device is provided in the embodiment of the present invention. A frame of an original display image of the display device includes at least one area, and each area includes a plurality of pixels. The display device includes:

an image dividing module, configured to divide the frame of the original display image in one of the area into a first frame display image and a second frame display image; wherein each pixel in the original display image, the first frame display image, and the second frame display image includes a component corresponding to a first color space, the component including a first component, a second component, and a third component;

an average value obtaining module, electrically connected to the image dividing module and configured to obtain a first average value, a second average value and a third average value corresponding to the original display image in the area; wherein the first average value, the second average value and the third average value are average values of the first component, the second component and the third component corresponding to the original display image respectively, and the first average value is larger than the second average value and larger than the third average value;

a component setting module, electrically connected to the average value obtaining module and configured to set the average values of the first component, the second component, and the third component corresponding to the first frame display image in the area to be equal to the second average value, and set the average values of both the first component and the third component corresponding to the second frame display image to be equal to the third average value, and the average value of the second component corresponding to the second frame display image to be equal to zero;

a backlight adjusting module, electrically connected to the component setting module and configured to adjust lightness of a backlight module according to the average values of the first component, the second component, and the third component corresponding to the original display image, the first frame display image, and the second frame display image in the area respectively;

a driving component obtaining module, electrically connected to the backlight adjusting module and configured to obtain a driving component corresponding to the pixel in the second frame display image, according to the lightness of the backlight module before and after adjustment, the component corresponding to the pixel in the original display image, and the driving component corresponding to the pixel in the first frame display image corresponding to the area; wherein the driving component corresponding to the pixel in the first frame display image is equal to a secondary largest component corresponding to the pixel in the original display image;

a hue saturation obtaining module, electrically connected to the average value obtaining module and configured to obtain a hue angle value and a saturation in a second color space according to the first average value, the second average value, and the third average value;

a backlight setting module, electrically connected to the hue saturation obtaining module and the backlight module, and configured to set the lightness of the backlight module corresponding to a set component corresponding to the pixel in the second frame display image according to the hue angle value and the saturation; wherein the set component corresponds to the secondary largest component corresponding to the pixel in the original display image; and a driving module, electrically connected to the driving component obtaining module and configured to drive a pixel unit in the display device to display according to the driving component corresponding to the pixel in the first frame display image and the driving component corresponding to the pixel in the second frame display image in the area.

Optionally, the display device further includes:

a component determination module, configured to determine a relationship between the obtained driving component corresponding to the pixel in the second frame display image in the area with zero and with the first component corresponding to the pixel in the original display image, after obtaining a driving component corresponding to the pixel in the second frame display image, according to the lightness of the backlight module before and after adjustment, the component corresponding to the pixel in the original display image, and the driving component corresponding to the pixel in the first frame display image corresponding to the area;

set the driving component corresponding to the pixel in the second frame display image to be equal to zero, when the obtained driving component corresponding to the pixel in the second frame display image is smaller than zero;

set the driving component corresponding to the pixel in the second frame display image to be equal to a maximum component corresponding to the pixel, when the obtained driving component corresponding to the pixel in the second frame display image is larger than the maximum component corresponding to the pixel.

Optionally, the backlight module includes a first backlight module, a second backlight module and a third backlight module, wherein the backlight adjusting module is configured to:

adjust the lightness of the first backlight module according to the grayscale lightness value of the average value of the first component corresponding to the original display image, the first frame display image, and the second frame display image in the area respectively;

adjust the lightness of the second backlight module according to the grayscale lightness value of the average value of the second component corresponding to the original display image, the first frame display image, and the second frame display image in the area respectively; and adjust the lightness of the third backlight module according to the grayscale lightness value of the average value of the third component corresponding to the original display image, the first frame display image, and the second frame display image in the area respectively.

Optionally, the backlight module includes a first backlight module, a second backlight module and a third backlight module, and the driving component obtaining module is configured to:

obtain the driving component corresponding to the first component of the pixel in the second frame display image according to the lightness of the first backlight module before and after adjustment, the first component corresponding to the pixel in the original display image, and the driving component corresponding to the pixel in the first frame display image corresponding to the area;

obtain the driving component corresponding to the second component of the pixel in the second frame display image according to the lightness of the second backlight module before and after adjustment, the second component corresponding to the pixel in the original display image, and the driving component corresponding to the pixel in the first frame display image corresponding to the area; and obtain the driving component corresponding to the third component of the pixel in the second frame display image according to the lightness of the third backlight module before and after adjustment, the third component corresponding to the pixel in the original display image, and the driving component corresponding to the pixel in the first frame display image corresponding to the area.

Optionally, the first color space is a red, green, and blue, RGB color space.

Optionally, the first component, the second component, and the third component of the preset color space correspond to a red component, a green component, and a blue component in the RGB color space respectively.

Optionally, the second color space is an LCH color space.

Optionally, the display device is a liquid crystal display device.

A driving method for a display device is further provided in the embodiment of present invention. A frame of an original display image of the display device includes at least one area, and each area includes a plurality of pixels. The driving method includes:

dividing the frame of the original display image in one of the area into a first frame display image and a second frame display image; wherein each pixel in the original display image, the first frame display image, and the second frame display image includes a component corresponding to a first color space, the component including a first component, a second component, and a third component;

obtaining a first average value, a second average value, and a third average value corresponding to the original display image; wherein the first average value, the second average value, and the third average value are the average values of the first component, the second component, and the third component corresponding to the original display image respectively, and the first average value is larger than the second average value, the second average value is larger than the third average value;

setting the average values of the first component, the second component, and the third component corresponding to the first frame display image in the area to be equal to the second average value, and setting the average values of both the first component and the third component corresponding to the second frame display image to be equal to the third average value, and setting the average value of the second component corresponding to the second frame display image to be equal to zero;

adjusting lightness of the first backlight module according to a grayscale lightness value of the average value of the first component corresponding to the original display image, the first frame display image, and the second frame display image in the area respectively; adjusting the lightness of the second backlight module according to the grayscale lightness value of the average value of the second component corresponding to the original display image, the first frame display image, and the second frame display image in the area respectively; adjusting the lightness of the third backlight module according to the grayscale lightness value of the average value of the third component corresponding to the original display image, the first frame display image, and the second frame display image in the area respectively;

obtaining a driving component corresponding to the first component of the pixel in the second frame display image according to the lightness of the first backlight module before and after adjustment, the first component corresponding to the pixel in the original display image, and the driving component corresponding to the pixel in the first frame display image corresponding to the area; obtaining the driving component corresponding to the second component of the pixel in the second frame display image according to the lightness of the second backlight module before and after adjustment, the second component corresponding to the pixel in the original display image, and the driving component corresponding to the pixel in the first frame display image corresponding to the area; obtaining the driving component corresponding to the third component of the pixel in the second frame display image according to the lightness of the third backlight module before and after adjustment, the third component corresponding to the pixel in the original display image, and the driving component corresponding to the pixel in the first frame display image corresponding to the area; wherein the driving components corresponding to the first component, the second component and the third component of the pixel in the first frame display image are all equal to a secondary largest component corresponding to the pixel in the original display image;

obtaining a hue angle value and a saturation in a second color space according to the first average value, the second average value, and the third average value;

setting the lightness of the backlight module corresponding to a set component corresponding to the pixel in the second frame display image according to the hue angle value and the saturation; wherein the set component corresponds to the secondary largest component corresponding to the pixel in the original display image; and driving a pixel unit in the display device according to the driving component of the first component, the second component, and the third component of the corresponding pixel in the first frame display image and the driving component of the first component, the second component, and the third component of the corresponding pixel in the second frame display image in the area.

Optionally, the first color space is a red, green, and blue, RGB color space.

Optionally, the second color space is an LCH color space.

The embodiment of the present disclosure provides a computer readable storage medium, having computer executable instructions stored thereon, and any method described above is implemented when the computer executable instructions are executed.

The embodiment of the present disclosure provides a display device that includes one or more processors, a memory, and one or more programs stored on the memory, and when executed by the one or more processors, any of the method described above is implemented.

The embodiment of the present disclosure provides a computer program product including computer programs stored on a non-transitory computer readable storage medium, and the computer programs includes program instructions, when executed by a computer, any of the methods described above is implemented by the computer.

DETAILED DESCRIPTION OF THE EMBODIMENTS

A display panel of a display device includes a plurality of hue combinations, and the hue combination of which color the display panel is, and the color shown by the display panel as a whole is the color. Taking the display panel being the red hue combination as an example, in a case of a positive viewing angle, a red component of a pixel in the display panel is more predominant than a blue component and a green component of the pixel in the display panel, but in a case of a large viewing angle, a ratio of the red component of the pixel to the blue component and the green component of the pixel in the display panel is seriously declined. And the smaller the ratio of the red component of the pixel in the display panel to the blue component and the green component of the pixel in the display panel is, the more seriously the color shown by the display panel shifts from the red, that is, the more seriously the color shifts between the large viewing angle and the positive viewing angle, the more serious the color shift problem of the display panel is.

In addition, still taking the display panel being the red hue combination as an example, a difference of the ratio of the red component to the blue component and the green component between the case of the positive viewing angle and the large viewing angle for a low grayscale pixel is larger than that for a high grayscale pixel, and the problem of the color shift is more serious.

Figure 1:
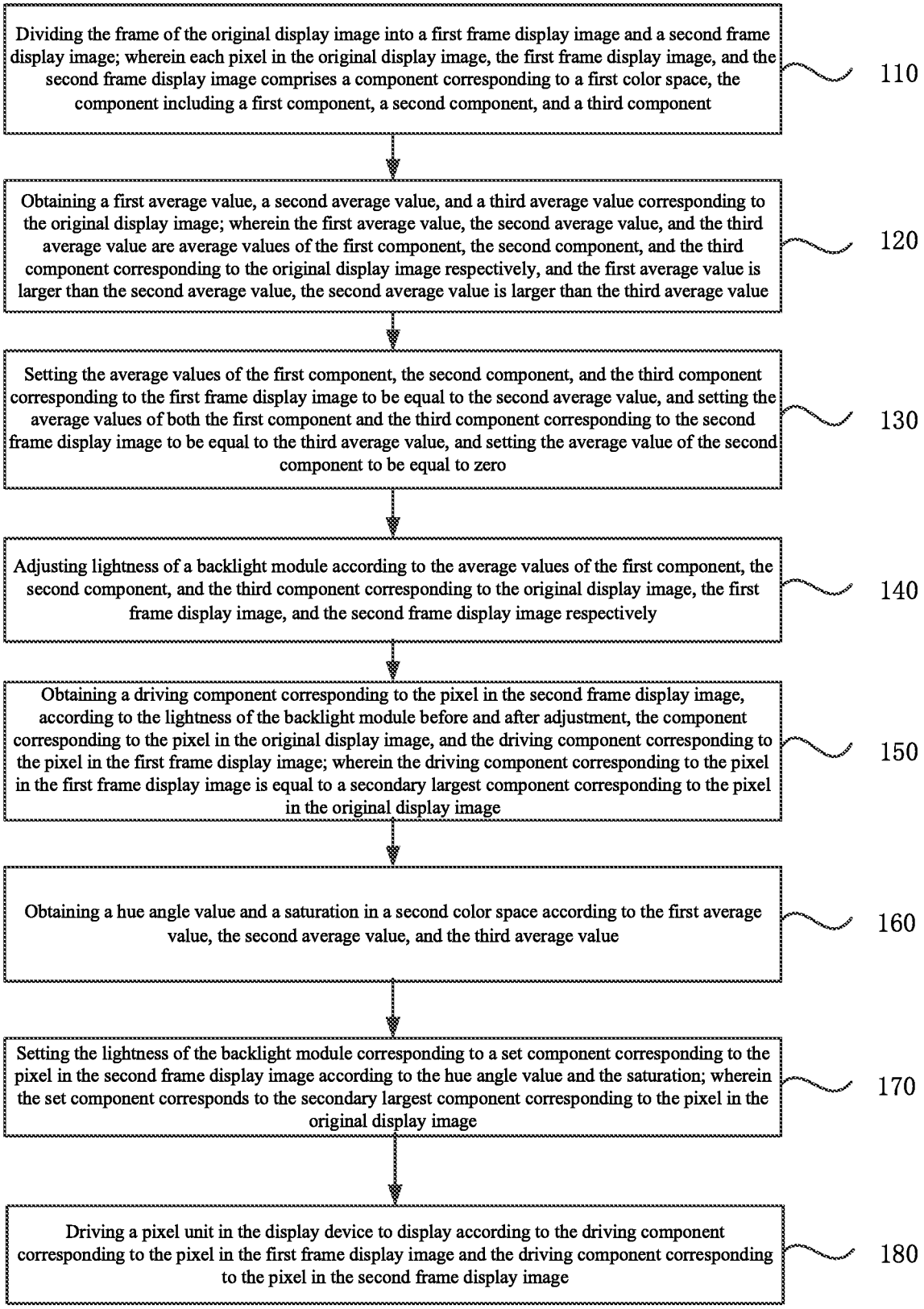
FIG. 1 is a flow diagram of a driving method of a display device in accordance with one embodiment of the present disclosure.

FIG. 1 is a flow diagram of a driving method of a display device in accordance with one embodiment of the present disclosure. The driving method may be applied to a scene where the display device needs to be driven to display, and may be executed by the display device according to one embodiment. Pixels of a frame of an original display image of the display device belong to at least one area, and each area includes a plurality of pixels. When the pixels of one frame of the original display image of the display device belong to one area, the driving method includes:

Step 110: dividing the frame of the original display image into a first frame display image and a second frame display image; wherein each pixel in the original display image, the first frame display image, and the second frame display image comprises a component corresponding to a first color space, the component including a first component, a second component, and a third component.

Exemplarily, the first color space may be provided as an RGB color space, and the first component, the second component, and the third component correspond to a red component, a green component, and a blue component in the RGB color space, respectively.

Step 120: obtaining a first average value, a second average value, and a third average value corresponding to the original display image; wherein the first average value, the second average value, and the third average value are average values of the first component, the second component, and the third component corresponding to the original display image respectively, and the first average value is larger than the second average value, the second average value is larger than the third average value.

Each pixel in the original display image corresponds to the first component, the second component, and the third component, and an average value of the first component corresponding to all the pixels in the original display image may be set to be a first average value corresponding to the original display image, an average value of the second component corresponding to all the pixels in the original display image may be set to a second average value corresponding to the original display image, and an average value of the third component corresponding to all the pixels in the original display image may be set to a third average value corresponding to the original display image, and the first average value is larger than the second average value, the second average is larger than the third average value. Exemplarily, the first component, the second component, and the third component may be set to correspond to the red component, the green component, and the blue component in the RGB color space, respectively, then the display panel is a red hue combination, that is, the display panel as a whole presents a red color.

Step 130: setting the average values of the first component, the second component, and the third component corresponding to the first frame display image to be equal to the second average value, and setting the average values of both the first component and the third component corresponding to the second frame display image to be equal to the third average value, and setting the average value of the second component to be equal to zero.

Exemplarily, the first average value, the second average value, the third average value, corresponding to the original display image, may be set as A, B, C, respectively, and A is larger than B, and B is larger than C. Then the average value of the first component, the second component and the third component corresponding to the first frame display image may be set equal to B, the average value of the first component and the third component corresponding to the second frame display image may be set equal to C, and the average value of the second component corresponding to the second frame display image may be set equal to zero. Since the average value of the second component corresponding to the first frame display image is equal to the average value of the second component corresponding to the original display image, that is, both are equal to the second average value, the average value of the second component corresponding to the second frame display image may be set equal to zero.

Step 140: adjusting lightness of a backlight module according to the average values of the first component, the second component, and the third component corresponding to the original display image, the first frame display image, and the second frame display image respectively.

Exemplarily, the backlight module may be configured to include a first backlight module, a second backlight module, and a third backlight module. The lightness of the first backlight module may be adjusted according to a grayscale lightness value of the average value of the first component corresponding to the original display image, the first frame display image, and the second frame display image respectively. The lightness of the second backlight module may be adjusted according to the grayscale lightness value of the average value of the second component corresponding to the original display image, the first frame display image, and the second frame display image respectively. The lightness of the third backlight module may be adjusted according to the grayscale lightness value of the average value of the third component corresponding to the original display image, the first frame display image, and the second frame display image respectively.

Exemplarily, the first component, the second component, and the third component may be set to correspond to the red component, the green component, and the blue component in the RGB color space, respectively, and the first backlight module, the second backlight module, and the third backlight module are a red backlight module, a green backlight module, and a blue backlight module, respectively. The lightness of the red backlight module may be adjusted according to the grayscale lightness value of the average value of the red component corresponding to the original display image, the first frame display image, and the second frame display image respectively. The lightness of the green backlight module may be adjusted according to the grayscale lightness value of the average value of the green component corresponding to the original display image, the first frame display image, and the second frame display image respectively. The lightness of the blue backlight module may be adjusted according to the grayscale lightness value of the average value of the blue component corresponding to the original display image, the first frame display image, and the second frame display image respectively.

Referring to step 130, in the case of the positive viewing angle, the grayscale lightness values of the average value of the first component, the average value of the second component and the average value of the third component corresponding to the original display image may be set as TR1 (A), TG1 (B) and TB1 (C), respectively. The grayscale lightness values of the average value of the first component, the average value of the second component and the average value of the third component corresponding to the first frame display image may be set as TR2 (B), TG2 (B) and TB2 (B). The grayscale lightness values of the average value of the first component, the average value of the second component and the average value of the third component corresponding to the second frame display image may be set as TR3 (C), TG3 (0) and TB3 (C). The lightness of the first backlight module, the second backlight module and the third backlight module before adjustment are set as AR, AG and AB, respectively, then the lightness of the first backlight module, the second backlight module and the third backlight module after adjustment has the following calculation formulas:

$$AR1 = 2 \times AR \times \frac{TR1(A)}{TR2(B) + TR3(C)}$$

$$AG1 = 2 \times AG \times \frac{TG1(B)}{TG2(B) + TG3(0)} = 2 \times AG$$

$$AB1 = 2 \times AB \times \frac{TB1(C)}{TB2(B) + TB3(C)}$$

A frame of the original display image is divided into the first frame display image and the second frame display image, and display time of each frame of the display image becomes half of the original frame display image, therefore in the above formula, in addition to considering a component factor, the lightness of the backlight module before adjustment needs to be multiplied by two, that is, a change of the display time is compensated by the adjustment of the lightness of the backlight module.

Exemplarily, A is set to be equal to 100, B is set to be equal to 80, and C is set to be equal to 40, that is, the average value of the first component, the average value of the second component and the average value of the third component corresponding to the original display image are 100, 80, and 40, respectively. Then the average value of the first component, the average value of the second component and the average value of the third component corresponding to the first frame display image may be set as 80. The average value of the first component and the average value of the third component corresponding to the second frame display image may be set as 40, and the average value of the second component corresponding to the second frame display image may be set as 0.

Exemplarily, referring to photoelectric characteristics of a VA type liquid crystal display panel, taking a data format of the grayscale value as 8 bits (the grayscale value ranges from 0-255 grayscale) as an example, grayscale value lightness and the grayscale value have the following formula:

$$Y = \left(\frac{X}{255}\right)^{2.2}$$

Wherein X represents the grayscale value, that is, the component mentioned in the previous embodiment, Y represents the grayscale value lightness, that is, normalized lightness, that is, the grayscale lightness value of the average value of the component mentioned in the previous embodiment, both of which are in accordance with the relationship of exponential power 2.2. The grayscale value lightness needed to be obtained can be determined through a table or according to the above formula. TR1 (A), TG1 (B) and TB1 (C) are 13.3%, 7.4% and 1.7% respectively, and TR2 (B), TG2 (B) and TB2 (B) are 8.2%, 7.4% and 7.4% respectively, and TR3(C), TG3 (0) and TB3 (C) are 1.8%, 0 and 1.7% respectively. According to the above formula, AR1 is equal to 2.66 times AR, AG1 is equal to 2 times AG, AB1 is equal to 0.347 times AB.

Exemplarily, referring to the photoelectric characteristics of the VA type liquid crystal display panel, the grayscale value and the grayscale value lightness in the case of the positive viewing angle conform to the above relationship of the exponential power 2.2. In a case of a side viewing angle, there is a one-to-one correspondence between the grayscale value and the grayscale value lightness, which is related to the pixel design of the VA liquid crystal display panel. Exemplarily, the case of the side viewing angle meets the following conditions: when the average value A of the first component, the average value B of the second component and the average value C of the third component corresponding to the original display image are 100, 80 and 40 respectively, the average value of the first component, the average value of the second component and the average value of the third component corresponding to the first frame display image are 80, the average value of the first component and the average value of the third component corresponding to the second frame display image are 40, and the average value of the second component corresponding to the second frame display image is 0, the grayscale lightness values TR1 (A), TG1 (B) and TB1 (C) of three components of each pixel in the original display image are 39%, 34.7% and 23.1% respectively, and the grayscale lightness values TR2 (B), TG2 (B) and TB2 (B) of three components of each pixel in the first frame display image are 32.6%, 34.7% and 42.1% respectively, and the grayscale lightness values TR3 (C), TG3(0) and TB3(C) of three components of each pixel in the second frame display image are 17.6%, 0 and 23.1% respectively, then for the first frame display image and the second frame display image, the grayscale lightness value ratio of the first component D1, the grayscale lightness value ratio of the second component D2, and the grayscale lightness value ratio of the third component D3 satisfy the following formulas:

$$D1=2.66\times[TR2(B)+TR3(C)]$$

$$D2=2\times[TG2(B)+TG3(0)]$$

$$D3=0.374\times[TB2(B)+TB3(C)]$$

By introducing parameters into the above calculation formula of D1, D2 and D3, it is obtained that D1 is equal to 133.5%, D2 is equal to 69.4%, D3 is equal to 24.4%, and with respect to the case of the side viewing angle that TR1 (A), TG1 (B) and TB1 (C) are 39%, 34.7% and 23.1% respectively, the ratio of the red component to the green component is raised from the ratio of 39% to 34.7%, namely 1.124, to the ratio of 133.5% to 69.4%, namely 1.924, and the ratio of the red component to the blue component is raised from the ratio of 39% to 23.1%, namely 1.688, to the ratio of 133.5% to 24.4%, namely 5.471, which effectively increases the main hue component, such as the grayscale lightness value ratio of the red component, and increases the grayscale lightness value ratio of the main hue component relative to other components in the case of the side viewing angle, so that the color that the display panel shows is closer to the main hue. The color shift of the display panel in the case of the large viewing angle is improved, and the problem that the difference of the grayscale lightness value ratio of the main hue component to the other components between the case of the positive viewing angle and the large viewing angle for the low grayscale pixel is larger than that for the high grayscale pixel is improved.

Step 150: obtaining a driving component corresponding to the pixel in the second frame display image, according to the lightness of the backlight module before and after adjustment, the component corresponding to the pixel in the original display image, and the driving component corresponding to the pixel in the first frame display image; wherein the driving component corresponding to the pixel in the first frame display image is equal to a secondary largest component corresponding to the pixel in the original display image.

Exemplarily, the backlight module may be configured to include a first backlight module, a second backlight module, and a third backlight module. The driving component corresponding to the first component of the pixel in the second frame display image is obtained, according to the lightness of the first backlight module before and after adjustment, the first component corresponding to the pixel in the original display image, and the driving component corresponding to the pixel in the first frame display image. The driving component corresponding to the second component of the pixel in the second frame display image is obtained, according to the lightness of the second backlight module before and after adjustment, the second component corresponding to a pixel in the original display image, and the driving component corresponding to the pixel in the first frame display image. The driving component corresponding to the third component of the pixel in the second frame display image is obtained, according to the lightness of the third backlight module before and after adjustment, the third component corresponding to a pixel in the original display image, and the driving component corresponding to the pixel in the first frame display image.

Exemplarily, the first component, the second component and the third component may be set to correspond to the red component, the green component and the blue component in the RGB color space, respectively, and the first backlight module, the second backlight module and the third backlight module are the red backlight module, the green backlight module and the blue backlight module, respectively. The driving component corresponding to the red component of the pixel in the second frame display image is obtained, according to the lightness of the red backlight module before and after adjustment, the red component corresponding to a pixel in the original display image and the driving component corresponding to the pixel in the first frame display image. The driving component corresponding to the green component of the pixel in the second frame display image is obtained, according to the lightness of the green backlight module before and after adjustment, the green component corresponding to a pixel in the original display image and the driving component corresponding to the pixel in the first frame display image. The driving component corresponding to the blue component of the pixel in the second frame display image is obtained, according to the lightness of the blue backlight module before and after adjustment, the blue component corresponding to a pixel in the original display image and the driving component corresponding to the pixel in the first frame display image.

Referring to step 130 and step 140, in the first case, a size relationship of the first component, the second component, and the third component corresponding to the pixel in the original display image is the same as the size relationship of the average value of the first component, the average value of the second component, and the average value of the third component corresponding to the original display image, that is, the average value of the first component corresponding to the original display image is larger than the average value of the second component, the average value of the second component is larger than the average value of the third component, and the first component corresponding to the pixel in the original display image is larger than the second component, and the second component is larger than the third component.

Exemplarily, the first component, the second component, and the third component corresponding to the pixel in the original display image may be set to A1, B1, and C1, and A1 is larger than B1, B1 is larger than C1, and the grayscale lightness values corresponding to the three are TR1 (A1), TG1 (B1), and TB1 (C1), respectively. In the first frame display image, the drive component corresponding to the first component of the pixel, the drive component corresponding to the second component of the pixel and the drive component corresponding to the third component of the pixel are all set to B1, that is, the driving component corresponding to the pixel in the first frame display image is set to be equal to the secondary largest component B1 corresponding to the pixel in the original display image, and the grayscale lightness values corresponding to the three are TR2 (B1), TG2 (B1) and TB2 (B1), respectively. With combination of the calculation formulas of the lightness AR1, AG1 and AB1 of the backlight module after adjustment, the driving component TR3 corresponding to the first component of the pixel, the driving component TG3 corresponding to the second component of the pixel, and the driving component corresponding to the third component TB3 of the pixel in the second frame display image satisfy the following formulas:

$$TR3 = \frac{2 \times AR \times TR1(A1)}{AR1} - TR2(B1) = \frac{TR1(A1) \times [TR2(B) + TR3(C)]}{TR1(A)} - TR2(B1)$$

$$TG3 = \frac{2AG \times TG1(B1)}{AG1} - TG2(B1) = \frac{TG1(B1) \times [TG2(B) + TG3(0)]}{TG1(B)} - TG2(B1) = 0$$

$$TB3 = \frac{2AB \times TB1(C1)}{AB1} - TB2(B1) = \frac{TB1(C1) \times [TB2(B) + TB3(C)]}{TB1(C)} - TB2(B1)$$

In the second case, the size relationship of the first component, the second component and the third component corresponding to the pixel in the original display image is different from the size relationship of the average value of the first component, the average value of the second component and the average value of the third component corresponding to the original display image. Exemplarily, the average value of the first component corresponding to the original display image is larger than the average value of the second component, the average value of the second component is larger than the average value of the third component, the second component corresponding to the pixel of the original display image is larger than the third component, and the third component is larger than the first component.

Exemplarily, the first component, the second component and the third component corresponding to the pixel in the original display image may be set to A2, B2 and C2, and B2 is larger than C2, and C2 is larger than A2, and the grayscale lightness values corresponding to the three may be TR1 (A2), TG1 (B2) and TB1 (C2), respectively. The driving component corresponding to the first component of the pixel, the driving component corresponding to the second component of the pixel and the driving component corresponding to the third component of the pixel in the first frame display image are set to C2, C2 and C2 respectively, that is, the driving components corresponding to the pixel in the first frame display image are all set to be equal to the secondary large component C2 corresponding to the pixel in the original display image, and the grayscale lightness values corresponding to the three are TR2 (C2), TG2 (C2) and TB2 (C2), respectively. With combination of the calculation formulas of the lightness AR1, AG1 and AB1 of the backlight module after adjustment, the driving component TR31 corresponding to the first component of the pixel, the driving component TG31 corresponding to the second component of the pixel, and the driving component corresponding to the third component TB31 of the pixel in the second frame display image satisfy the following formulas:

$$TR31 = \frac{2AR \times TR1(A2)}{AR1} - TR2(C2) = \frac{TR1(A2) \times [TR2(B) + TR3(C)]}{TR1(A)} - TR2(C2)$$

$$TG31 = \frac{2AG \times TG1(B2)}{AG1} - TG2(C2) = \frac{TG1(B2) \times [TG2(B) + TG3(0)]}{TG1(B)} - TG2(C2) = TG1(B2) - TG2(C2)$$

$$TB31 = \frac{2AB \times TB1(C2)}{AB1} - TB2(C2) = \frac{TB1(C2) \times [TB2(B) + TB3(C)]}{TB1(C)} - TB2(BC2)$$

Optionally, after obtaining the driving component corresponding to each pixel in the second frame display image, the relationship between the obtained driving component corresponding to the pixel in the second frame display image and zero, and the first component corresponding to the pixel in the original display image needs to be determined. If the driving component corresponding to the pixel in the second frame display image is smaller than zero, the driving component corresponding to the pixel in the second frame display image is set to be equal to zero, and if the driving component corresponding to the pixel in the second frame display image is larger than the maximum component corresponding to the pixel, the driving component corresponding to the pixel in the second frame display image is set to be equal to the maximum component corresponding to the pixel.

In the second case described above, since the size relationship of the first component, the second component and the third component corresponding to the pixel in the original display image is different from the size relationship of the average value of the first component, the average value of the second component and the average value of the third component corresponding to the original display image, therefore, TR31, TG31 and TB31 obtained according to the above formulas may be smaller than zero or larger than the maximum component, which may be 255 grayscale for example, taking 8-bit grayscale value as an example, corresponding to the pixel in the original image. Thus, before determining the second component, the relationship between the driving component corresponding to the pixel in the second frame display image and zero, and the maximum component, which may be 255 grayscale for example, taking 8-bit grayscale value as an example, corresponding to the pixel in the original image should be determined. When the obtained driving component corresponding to the pixel in the second frame display image is smaller than zero, the driving component corresponding to the pixel in the second frame display image is set to be equal to zero. When the obtained driving component corresponding to the pixel in the second frame display image is larger than the maximum component, which may be 255 grayscale for example, taking 8-bit grayscale value as an example, corresponding to the pixel, the driving component corresponding to the pixel in the second frame display image may be set equal to the maximum component, which may be 255 grayscale for example, taking 8-bit grayscale value as an example, corresponding to the pixel, so as to ensure normal display of the pixel unit in the display panel.

Step 160: obtaining a hue angle value and a saturation in a second color space according to the first average value, the second average value, and the third average value.

Exemplarily, the first color space may be the RGB color space, then the first component, the second component, and the third component are the red component, the green component, and the blue component, respectively. The RGB color space is defined based on the color recognized by the human eye, which represents three quantities of the hue angle value, the lightness, and the saturation together such that the red component, the green component, and the blue component are correlated with each other. The first average value, the second average value, and the third average value may be set to Ave R, Ave G, and Ave B, respectively.

The second color space may be exemplarily set to an LCH color space, the RGB color space is converted to the LCH color space (L is lightness, C is saturation, H is hue angle value), where lightness L, saturation C and hue angle value H are mutually independent, and pixel unit parameters in the display panel may be determined according to a single component, for example, H may be equal to f1 (Ave R, Ave G, Ave B), and C may be equal to f2 (Ave R, Ave G, Ave B).

Step 170: setting the lightness of the backlight module corresponding to a set component corresponding to the pixel in the second frame display image according to the hue angle value and the saturation; wherein the set component corresponds to the secondary largest component corresponding to the pixel in the original display image.

Referring to the LCH color space, when the hue angle value corresponding to the pixel unit is 0°, the pixel unit shows a pure red color; when the hue angle value corresponding to the pixel unit is 90°, the pixel unit shows a pure yellow; when the hue angle value corresponding to the pixel unit is 180°, the pixel unit shows a pure green color; and when the hue angle value corresponding to the pixel unit is 270°, the pixel unit shows a pure blue color. As the hue angle value H of the pixel unit changes from 0° to 360°, the color of the pixel unit gradually changes from the pure red color to the pure yellow color, then gradually changes to the pure green color, then gradually changes to the pure blue color, and then gradually changes to the pure red color, and the range of the saturation of the pixel unit in the LCH color space may be equal to or larger than zero and equal to or smaller than 100, and when the saturation is 100, the color of the pixel unit is the most vivid.

Taking the first component, the second component, and the third component as the red component, the green component, and the blue component, respectively, for example, when the obtained hue angle value is larger than or equal to 0° and smaller than or equal to 60°, or larger than or equal to 330° and smaller than 360°, and the saturation C is larger than or equal to CTL1, and smaller than or equal to CTH1, it can be determined that the color of the display panel as a whole show more red. When the first average value is larger than the second average value and the second average value is larger than the third average value, the set component in the second frame display image corresponding to the secondary largest component corresponding to the pixel in the original display image may be set, and the lightness of the backlight module corresponding to the set component is zero, that is, the lightness of the green backlight module may be set to be zero, so as to save the energy. When the first average value is larger than the third average value, and the third average value is larger than the second average value, the set component of the second frame display image corresponding to the second largest component corresponding to the pixel in the original display image may be set, and the lightness of the backlight module corresponding to the set component is zero, that is, the lightness of the blue backlight module may be set to be zero, so as to save the energy.

Exemplarily, when the obtained hue angle value is larger than 60° and smaller than or equal to 120°, and the saturation C is larger than or equal to CTL2 and smaller than or equal to CTH2, it may be determined that the color of the display panel as a whole shows a mixed color of red and green. When the first average value is larger than the second average value and the second average value is larger than the third average value, the set component in the second frame display image corresponding to the secondary largest component corresponding to the pixel in the original display image may be set, and the lightness of the backlight module corresponding to the set component is zero, that is, the lightness of the green backlight module may be set to be zero, so as to save the energy. When the second average value is larger than the first average value and the first average value is larger than the third average value, the set component in the second frame display image corresponding to the secondary largest component corresponding to the pixel in the original display image may be set, and the lightness of the backlight module corresponding to the set component is zero, that is, the lightness of the red backlight module may be set to be zero, so as to save the energy.

Similarly, when the obtained hue angle value is larger than 120° and smaller than or equal to 210°, and the saturation C is larger than or equal to CTL3 and smaller than or equal to CTH3, it may be determined that the color of the display panel as a whole shows more green, and the secondary largest component may be a red component or a blue component. When the obtained hue angle value is larger than 210° and smaller than or equal to 240°, and the saturation C is larger than or equal to CTL4 and smaller than or equal to CTH4, it may be determined that the color of the display panel as a whole shows a mixed color of blue and green, the second average value is larger than the third average value, the third average value is larger than the first average value, or the third average value is larger than the second average value, the second average value is larger than the first average value, and the secondary largest component is a blue component or a green component. When the obtained hue angle value is larger than 240° and smaller than or equal to 300°, and the saturation C is larger than or equal to CTL5 and smaller than or equal to CTH5, it may be determined that the color of the display panel as a whole shows more blue, and the secondary largest component may be the red component or the green component. When the obtained hue angle value is larger than 300° and smaller than or equal to 330°, and the saturation C is larger than or equal to CTL6 and smaller than or equal to CTH6, it may be determined that the color of the display panel as a whole shows a mixed color of blue and red, and the third average value is larger than the first average value, the first average value is larger than the second average value, or the first average value is larger than the third average value, the third average value is larger than the second average value, and the secondary largest component is the red component or the blue component.

In the case described above, the set component in the second frame display image corresponding to the secondary largest component corresponding to the pixel in the original display image may be set, and the lightness of the backlight module corresponding to the set component is set to be zero, so as to save energy.

Referring to step 150, in the first case, when the size relationship of the first component, the second component and the third component corresponding to the pixel in the original display image is the same as the size relationship of the average value of the first component, the average value of the second component and the third component corresponding to the original display image, taking the first component, the second component and the third component, corresponding to the red component, the green component and the blue component in the RGB color space respectively as an example, then the obtained grayscale lightness value TG3 of the green component corresponding to the pixel in the second frame display image is always zero. If the green backlight module corresponding to the pixel still emits light, it will result to the waste of the energy. By setting the lightness of the backlight module corresponding to the set component corresponding to the pixel in the second frame display image to be zero, the energy will be saved. Wherein the set component corresponding to the pixel in the second frame display image corresponds to the secondary largest component corresponding to the pixel in the original display image.

Referring to step 150, in the second case, that it, when the size relationship of the first component, the second component, and the third component corresponding to the pixels in the original display image is different from the size relationship of the average value of the first component, the average value of the second component, and the average value of the third component, taking that the first component, the second component and the third component respectively correspond to the red component, the green component and the blue component in the RGB color space as an example, the obtained grayscale lightness value TG31 of the green component corresponding to the pixel in the second frame display image is TG31=TG1 (B2)−TG2 (C2), that is, TG31 is not equal to zero. In the second frame display image, the set component corresponding to the secondary largest component corresponding to the pixel in the original display image is set, and the brightness of the backlight module corresponding to the set component is zero, which may cause the pixel unit in the display device to be unable to display normally, but the first average value corresponding to the original display image is larger than the second average value, the second average value is larger than the third average value, that is, the display panel as a whole shows a red color, and the size relationship of the first component, the second component and the third component corresponding to only a very few pixels is different from the size relationship of the average value of the first component, the average value of the second component and the average value of the third component corresponding to the original display image. Therefore, the set component in the second frame display image corresponding to the second largest component corresponding to the pixel in the original display image is set, and the brightness of the corresponding backlight module is zero, which does not affect the output result of the overall image quality.

Step 180: driving a pixel unit in the display device to display according to the driving component corresponding to the pixel in the first frame display image and the driving component corresponding to the pixel in the second frame display image.

The component is the grayscale value, and each grayscale value corresponds to a driving voltage of the pixel unit. When the size relationship among the first component, the second component, and the third component corresponding to the pixel in the original display image is the same as the size relationship among the average value of the first component, the average value of the second component and the average value of the third component corresponding to the original display image, the driving components corresponding to the pixel in the second frame display image can be obtained according to the above formulas, that is, the grayscale values corresponding to TR3, TG3 and TB3, as well as the driving component corresponding to the pixel in the first frame display image, that is, B1, which drive the red pixel unit, the green pixel unit and the blue pixel unit in the display device to display respectively.

When the size relationship among the first component, the second component, and the third component corresponding to the pixel in the original display image and the size relationship among the average value of the first component, the average value of the second component and the average value of the third component corresponding to the original display image are different, the driving components corresponding to the pixel in the second frame display image can be obtained according to the above formulas, that is, the grayscale values corresponding to TR31, TG31 and TB31, as well as the driving component corresponding to the pixel in the first frame display image, that is, C2, which drive the red pixel unit, the green pixel unit and the blue pixel unit in the display device to display respectively.

Figure 2:
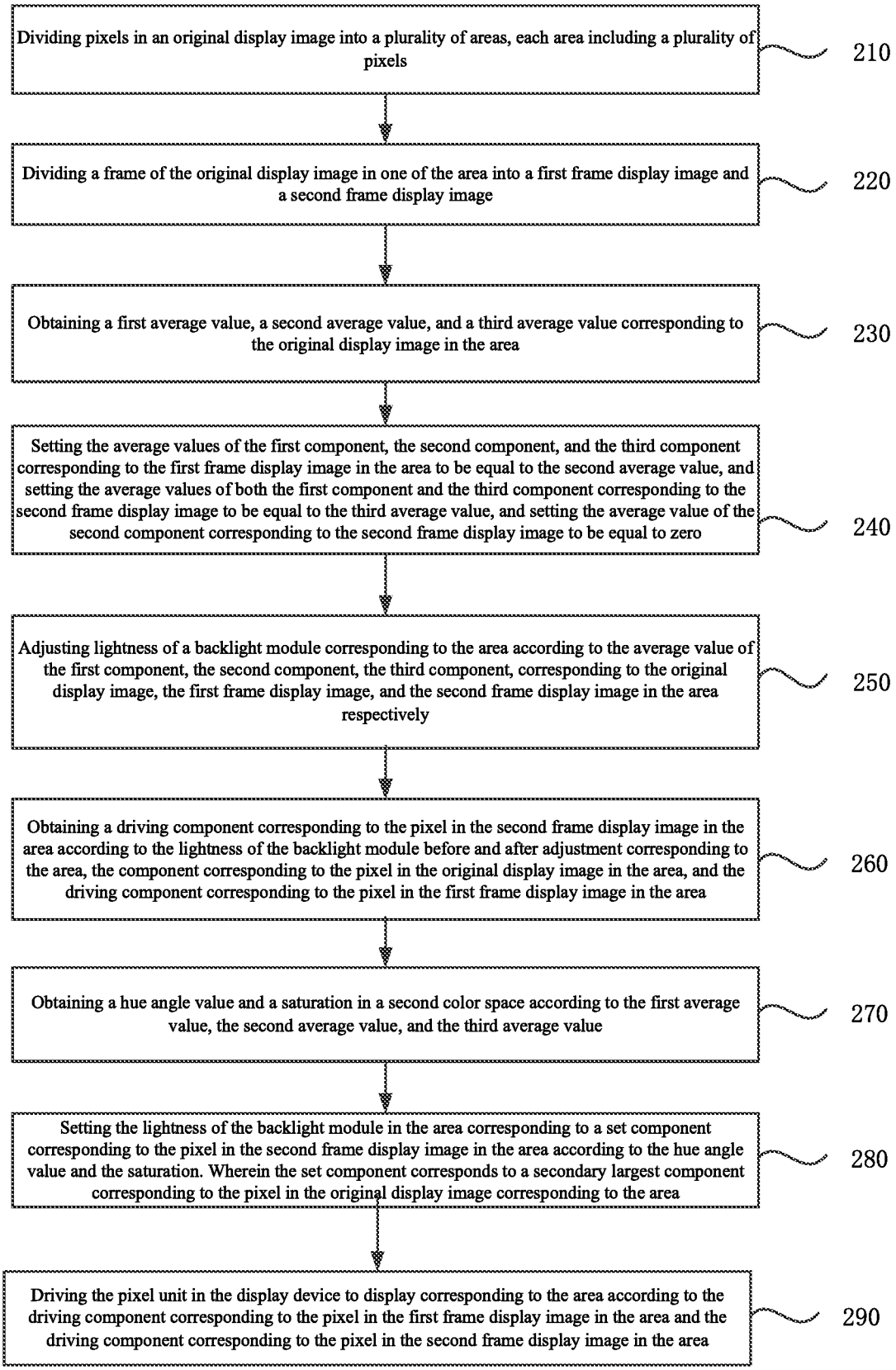
FIG. 2 is a flow diagram of a driving method of another display device in accordance with one embodiment of the present disclosure.

FIG. 2 is a flow diagram of a driving method of a display device in accordance with one embodiment of the present disclosure. The driving method may be applied to the scene that needs to drive the display device to display, and may be performed by the display device provided by the embodiments. The method includes:

Step 210: dividing pixels in an original display image into a plurality of areas, each area including a plurality of pixels.

The original display image may include a plurality of matrix-arranged pixels, and the pixels in the original display image may be divided into a plurality of areas, each of which may include multiple rows and multiple columns of pixels.

Step 220: dividing a frame of the original display image in one of the area into a first frame display image and a second frame display image.

Exemplarily, a frame of the original display image of a divided area may be divided into the first frame display image and the second frame display image, and each pixel of the original display image, the first frame display image, and the second display image in the area includes a first component, a second component, and a third component corresponding to a first color space.

Step 230: obtaining a first average value, a second average value, and a third average value corresponding to the original display image in the area.

The first components, the second components and the third components corresponding to all pixels in the original display image in the area may be set to be the first average value, the second average value, and the third average value, respectively, corresponding to the original display image, and the first average value is larger than the second average value, and the second average value is larger than the third average value.

Step 240: setting the average values of the first component, the second component, and the third component corresponding to the first frame display image in the area to be equal to the second average value, and setting the average values of both the first component and the third component corresponding to the second frame display image to be equal to the third average value, and setting the average value of the second component corresponding to the second frame display image to be equal to zero.

Exemplarily, the first average value, the second average value, the third average value corresponding to the original display image in the area may be set as A, B, and C respectively, and A is larger than B, B is larger than C, then the average value of the first component, the second component and the third component corresponding to the first frame display image in the area may be set equal to B, the average value of the first component and the third component corresponding to the second frame display image in the area may be set equal to C, and the average value of the second component corresponding to the second frame display image may be set equal to zero.

Step 250: adjusting lightness of a backlight module corresponding to the area according to the average value of the first component, the second component, the third component, corresponding to the original display image, the first frame display image, and the second frame display image in the area respectively.

Exemplarily, the backlight module may be configured to include a first backlight module, a second backlight module and a third backlight module. The lightness of the first backlight module corresponding to the area is adjusted according to a grayscale lightness value of the average values of the first components corresponding to the original display image, the first frame display image and the second frame display image in the area respectively. The lightness of the second backlight module corresponding to the area is adjusted according to the grayscale lightness values of the average values of the second component corresponding to the original display image, the first frame display image and the second frame display image in the area respectively. The lightness of the third backlight module corresponding to the area is adjusted according to the grayscale lightness values of the average values of the third component corresponding to the original display image, the first frame display image and the second frame display image in the area respectively. The specific calculation method of the backlight lightness is similar to the calculation method of AR1, AG1 and AB1 in step 140, which is not repeated here.

Figure 3:
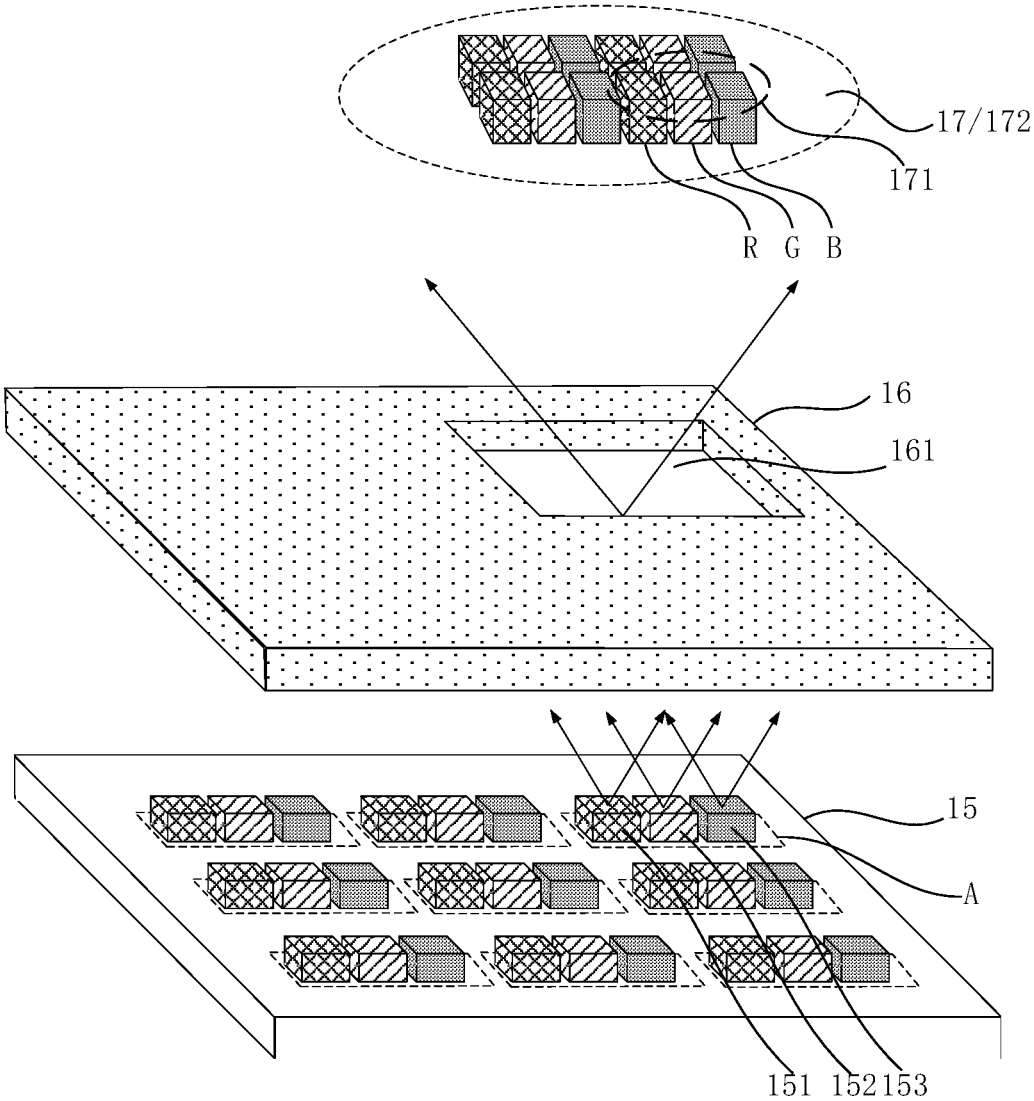
FIG. 3 is a structural diagram of a display device in accordance with one embodiment of the present disclosure.

Exemplarily, FIG. 3 is a structural diagram of the display device in accordance with one embodiment of the disclosure. The display device may be, for example, a liquid crystal display device, as shown in FIG. 3. The display device may include a display panel and a backlight module 15 disposed under the display panel. The backlight module 15 is configured to provide a light source for displaying to the display panel. The display panel may include an array substrate 16 adjacent to the backlight module, and a color film substrate 17 (only a partial area is shown) disposed on a side of the array substrate 16 away from the backlight module 15. The backlight module 15 may include a plurality of red backlight modules 151, green backlight modules 152, and blue backlight modules 153. The color film substrate 17 includes a plurality of pixel units 171 (four pixel units 171 are exemplarily shown in FIG. 3) accordingly, and each pixel unit 171 includes a red pixel unit R, a green pixel unit G and a blue pixel unit B. The light emitted by the backlight module 15 may be irradiated to a liquid crystal layer (not shown) disposed between the array substrate 16 and the color film substrate 17 through an opening area 161 on the array substrate 16, to perform the normal function of the liquid crystal display panel.

Exemplarily, as shown in FIG. 3, the area divided for the pixels in the original display image may be set to correspond to the area 172 formed by the pixel unit in FIG. 3, and a backlight module area A composed of a group of the red backlight module 151, the green backlight module 152, and the blue backlight module 153 may be set in the corresponding area 172. The lightness of the backlight module corresponding to the area is adjusted, that is, the lightness of the red backlight module 151, the green backlight module 152, and the blue backlight module 153 in the backlight module area A is adjusted, according to the average value of the first component, the second component, and the third component respectively corresponding to the original display image, the first frame display image, and the second frame display image in the area corresponding to the area 172 formed by the pixel unit.

Step 260: obtaining a driving component corresponding to the pixel in the second frame display image in the area according to the lightness of the backlight module before and after adjustment corresponding to the area, the component corresponding to the pixel in the original display image in the area, and the driving component corresponding to the pixel in the first frame display image in the area.

Exemplarily, the driving component corresponding to the first component of the pixel in the second frame display image in the area may be obtained, according to the lightness of the first backlight module before and after adjustment corresponding to the area, the first component corresponding to a pixel in the original display image in the area, and the driving component corresponding to the pixel in the first frame display image in the area. The driving component corresponding to the second component of the pixel in the second frame display image in the area may be obtained, according to the lightness of the second backlight module before and after adjustment corresponding to the area, the second component corresponding to a pixel in the original display image in the area, and the driving component corresponding to the pixel in the first frame display image in the area. The driving component corresponding to the third component of the pixel in the second frame display image in the area may be obtained, according to the lightness of the third backlight module before and after adjustment corresponding to the area, the third component corresponding to a pixel in the original display image in the area, and the driving component corresponding to the pixel in the first frame display image in the area. The specific method for calculating the drive component corresponding to the first component, the second component and the third component of the pixel in the second frame display image in the area is similar to the specific method for calculating TR3, TG3 and TB3 and TR31, TG31 and TB31 in step 150, which is not repeated here.

Step 270: obtaining a hue angle value and a saturation in a second color space according to the first average value, the second average value, and the third average value.

Step 280: setting the lightness of the backlight module in the area corresponding to a set component corresponding to the pixel in the second frame display image in the area according to the hue angle value and the saturation. Wherein the set component corresponds to a secondary largest component corresponding to the pixel in the original display image corresponding to the area.

Referring to step 160, the obtained set component in the second frame display image corresponding the secondary largest component corresponding to the pixel in the original display image may be set, according to the hue angle value and the saturation, and the lightness of the backlight module corresponding to the set component is set to be zero, so as to save the energy. Exemplarily, referring to FIG. 3, the area formed by the pixel corresponds to the area 172 formed by the pixel unit 171 on the color film substrate, and the lightness of the backlight module corresponding to the set component in the backlight module area A may be set to zero, so as to save the energy.

Step 290: driving the pixel unit in the display device to display corresponding to the area according to the driving component corresponding to the pixel in the first frame display image in the area and the driving component corresponding to the pixel in the second frame display image in the area.

The driving component corresponding to the pixel in the second frame display image in the area and the driving component corresponding to the pixel in the first frame display image in the area are obtained according to step 260, which drive the pixel unit of the display device corresponding to the area to display. By dividing the pixels in the original display image into a plurality of areas, the lightness of the backlight module in the display device is adjusted more accurately, and the driving components corresponding to the pixels of the first frame display image and the second frame display image are controlled more accurately.

The size of each element is merely illustratively represented in the drawings of the embodiments of the present invention, which does not represent the actual size of each element in the display panel.

Figure 4:
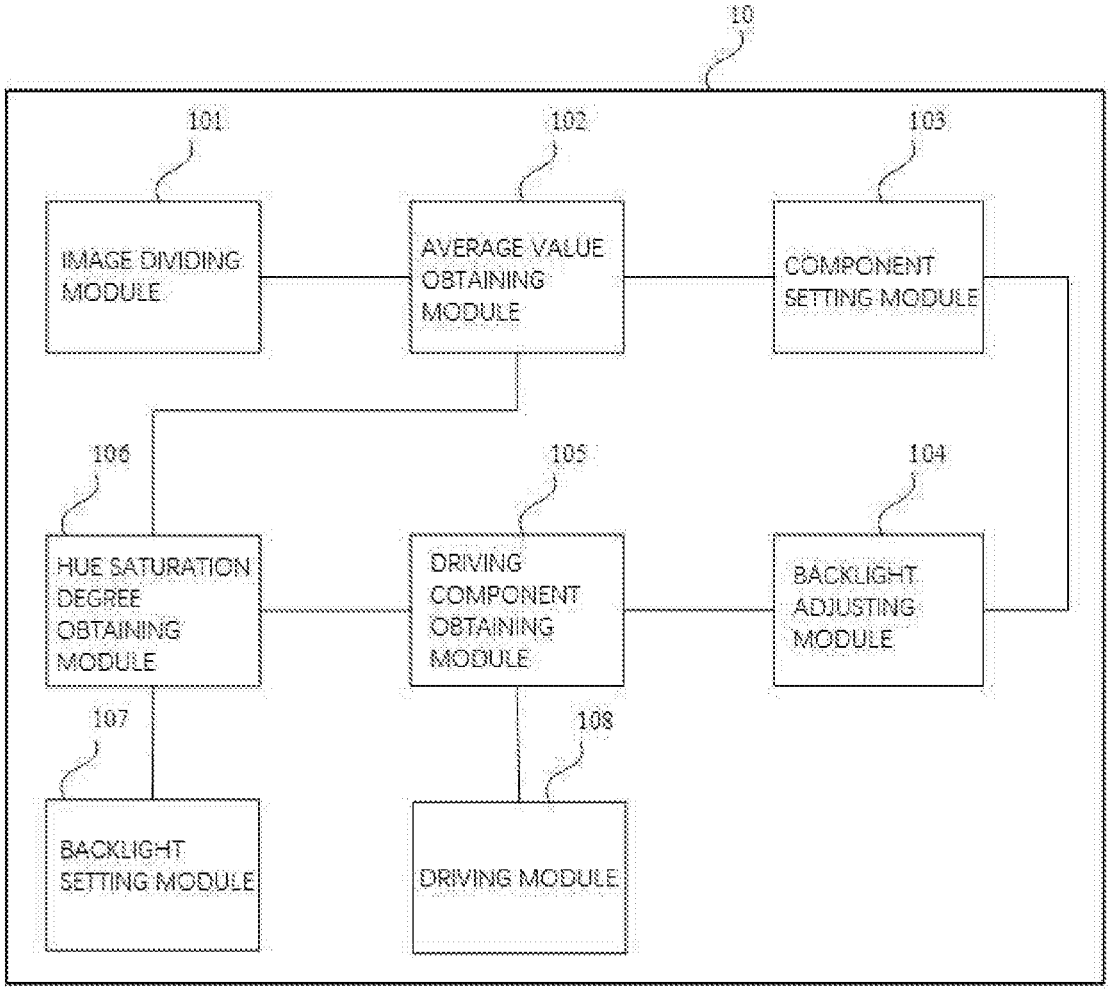
FIG. 4 is a structural diagram of another display device in accordance with one embodiment of the present disclosure.

FIG. 4 is a structural diagram of the display device in accordance with one embodiment of the disclosure. A frame of an original display image of the display device includes at least one area, and each area includes a plurality of the pixels. As shown in FIG. 4, the display device 10 includes an image dividing module 101, an average value obtaining module 102, a component setting module 103, a backlight adjusting module 104, a driving component obtaining module 105, and a hue saturation degree obtaining module 106, a backlight setting module 107 and a driving module 108. The average value obtaining module 102 is electrically connected to the image dividing module 101 and the component setting module 103, the backlight adjusting module 104 is electrically connected to the component setting module 103 and the driving component obtaining module 105, the hue saturation degree obtaining module 106 is electrically connected to the average value obtaining module 102 and the backlight setting module 107, the backlight setting module 107 is electrically connected to the backlight module, and the driving module 108 is electrically connected to the driving component obtaining module 105.

The image dividing module 101 is configured to divide the frame of the original display image in one of the area into a first frame display image and a second frame display image; wherein each pixel in the original display image, the first frame display image, and the second frame display image includes the component corresponding to a first color space, and the component includes a first component, a second component, and a third component. The average value obtaining module 102 is configured to obtain a first average value, a second average value and a third average value corresponding to the original display image in the area; wherein the first average value, the second average value and the third average value are the average values of the first component, the second component and the third component corresponding to the original display image in the area respectively, and the first average value is larger than the second average value and the second average value is larger than the third average value. The component setting module 103 is configured to set the average values of the first component, the second component, and the third component corresponding to the first frame display image in the area to be equal to the second average value, and set the average values of both the first component and the third component corresponding to the second frame display image to be equal to the third average value, and the average value of the second component to be equal to zero. The backlight adjusting module 104 is configured to adjust lightness of a backlight module according to the average values of the first component, the second component, and the third component corresponding to the original display image, the first frame display image, and the second frame display image in the area respectively. The driving component obtaining module 105 is configured to obtain the driving component corresponding to the pixel in the second frame display image, according to the lightness of the backlight module before and after adjustment, the component corresponding to the pixel in the original display image, and the driving component corresponding to the pixel in the first frame display image corresponding to the area; wherein the driving component corresponding to the pixel in the first frame display image is equal to the secondary largest component corresponding to the pixel in the original display image. The hue saturation obtaining module 106 is configured to obtain a hue angle value and a saturation in a second color space according to the first average value, the second average value, and the third average value. The backlight setting module 107 is configured to set the lightness of the backlight module corresponding to the set component corresponding to the pixel in the second frame display image according to the hue angle value and the saturation; wherein the set component corresponds to the secondary largest component corresponding to the pixel in the original display image. The driving module 108 is configured to drive the pixel unit in the display device to display according to the driving component corresponding to the pixel in the first frame display image and the driving component corresponding to the pixel in the second frame display image in the area.

Optionally, the display device may further include a component determining module for determining the relationship between the obtained driving component corresponding to the pixel in the second frame display image in the area and zero, and the first component corresponding to the pixel in the original display image. If the obtained driving component corresponding to the pixel in the second frame display image is smaller than zero, the driving component corresponding to the pixel in the second frame display image is set to be equal to zero; if the obtained driving component corresponding to the pixel in the second frame display image is larger than the maximum component corresponding to the pixel, the driving component corresponding to the pixel in the second frame display image is set to be equal to the maximum component corresponding to the pixel.

Figure 5:
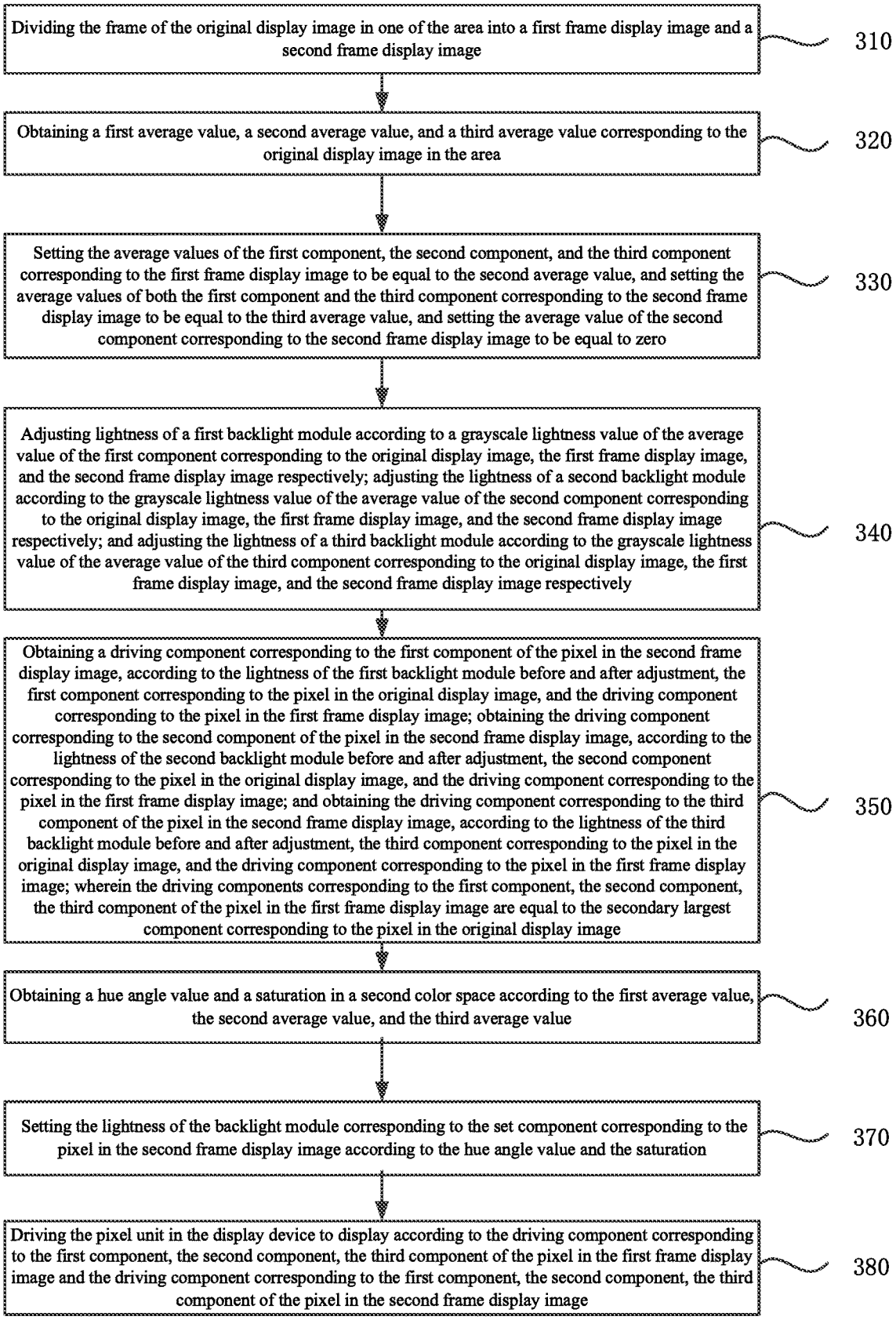
FIG. 5 is a flow diagram of a driving method of another display device in accordance with one embodiment of the present disclosure.

FIG. 5 is a flow diagram of the driving method for the display device in accordance with one embodiment of the present disclosure. The driving method may be applied to the scene that needs to drive the display device for displaying, and may be executed by the display device provided in the embodiment of the present invention. Pixels of a frame of an original display image of the display device belong to at least one area, and each area includes a plurality of pixels. The driving method includes:

Step 310: dividing the frame of the original display image in one of the area into a first frame display image and a second frame display image; wherein each pixel in the original display image, the first frame display image, and the second frame display image includes a component corresponding to a first color space, and the component includes a first component, a second component, and a third component.

Step 320: obtaining a first average value, a second average value, and a third average value corresponding to the original display image in the area; wherein the first average value, the second average value, and the third average value are average values of the first component, the second component, and the third component corresponding to the original display image respectively, and the first average value is larger than the second average value, the second average value is larger than the third average value.

Step 330: setting the average values of the first component, the second component, and the third component corresponding to the first frame display image to be equal to the second average value, and setting the average values of both the first component and the third component corresponding to the second frame display image to be equal to the third average value, and setting the average value of the second component corresponding to the second frame display image to be equal to zero.

Step 340: adjusting lightness of a first backlight module according to a grayscale lightness value of the average value of the first component corresponding to the original display image, the first frame display image, and the second frame display image respectively; adjusting the lightness of a second backlight module according to the grayscale lightness value of the average value of the second component corresponding to the original display image, the first frame display image, and the second frame display image respectively; and adjusting the lightness of a third backlight module according to the grayscale lightness value of the average value of the third component corresponding to the original display image, the first frame display image, and the second frame display image respectively.

Step 350: obtaining a driving component corresponding to the first component of the pixel in the second frame display image, according to the lightness of the first backlight module before and after adjustment, the first component corresponding to the pixel in the original display image, and the driving component corresponding to the pixel in the first frame display image; obtaining the driving component corresponding to the second component of the pixel in the second frame display image, according to the lightness of the second backlight module before and after adjustment, the second component corresponding to the pixel in the original display image, and the driving component corresponding to the pixel in the first frame display image; and obtaining the driving component corresponding to the third component of the pixel in the second frame display image, according to the lightness of the third backlight module before and after adjustment, the third component corresponding to the pixel in the original display image, and the driving component corresponding to the pixel in the first frame display image; wherein the driving components corresponding to the first component, the second component, the third component of the pixel in the first frame display image are equal to the secondary largest component corresponding to the pixel in the original display image.

Step 360: obtaining a hue angle value and a saturation in a second color space according to the first average value, the second average value, and the third average value.

Step 370: setting the lightness of the backlight module corresponding to the set component corresponding to the pixel in the second frame display image according to the hue angle value and the saturation; wherein the set component corresponds to the secondary largest component corresponding to the pixel in the original display image.

Step 380: driving the pixel unit in the display device to display according to the driving component corresponding to the first component, the second component, the third component of the pixel in the first frame display image and the driving component corresponding to the first component, the second component, the third component of the pixel in the second frame display image.

In the embodiments of the present disclosure, a frame of the original display image is divided into the first frame display image and the second frame display image, and the first component with the largest grayscale value in the original display image is divided into two components with the smaller grayscale value in the first frame display image and the second frame display image, in combination with the adjustment of the backlight lightness, the grayscale lightness value ratio of the main hue component of the pixel is improved, that is, the grayscale lightness value ratio of the main hue component relative to other components in the case of the side viewing angle is improved, so that the color of the display panel is closer to the main hue, and the color shift problem of the display panel in the case of the large viewing angle is improved. Meanwhile, the third component with the smallest grayscale value in the original display image is divided into the component with secondary largest grayscale value in the first frame display image and the third component in the second frame display image, in combination with the adjustment of the lightness of the backlight module, the problem that a difference of the grayscale lightness value ratio of the main hue component to other components between the case of the positive viewing angle and the large viewing angle for the low grayscale pixel is larger than that for the high grayscale pixel is improved, and the color shift problem of the display panel in the case of the large viewing angle is also improved. In addition, by setting the lightness of the backlight module corresponding to the set component corresponding to the pixel in the second frame display image according to the hue angle value and the saturation, the energy consumption of the display device is reduced.

A computer readable storage medium is further provided, having computer executable instructions stored thereon. Any method described above is implemented when the computer executable instructions are executed.

Figure 6:
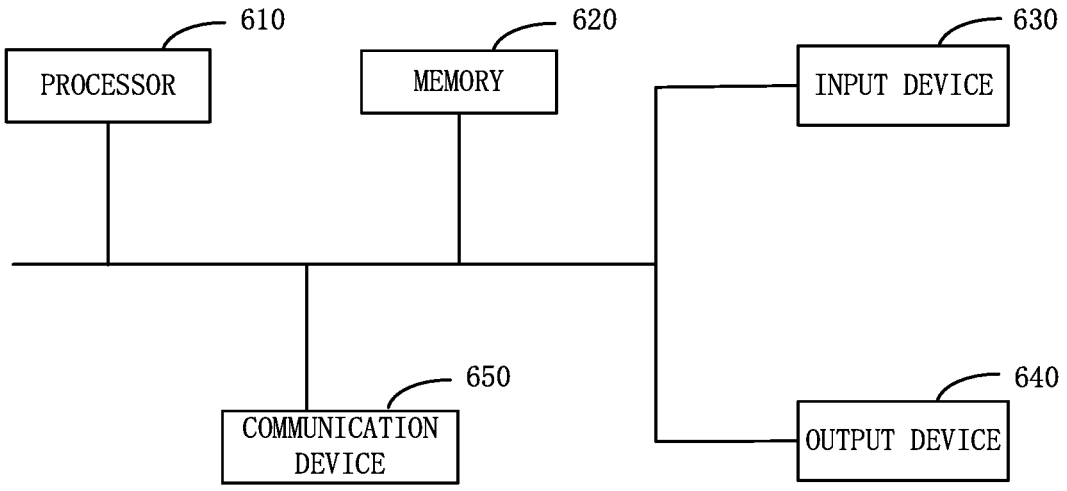
FIG. 6 is a hardware structural diagram of a display device in accordance with one embodiment of the present disclosure.

FIG. 6 is a hardware structural diagram of the display device in accordance with one embodiment of the disclosure. As shown in FIG. 6, the display device includes one or more processors 610 and a memory 620. In FIG. 6, a processor 610 is taken as an example.

The display device may further include an input device 630 and an output device 640.

The processor 610, the memory 620, the input device 630, and the output device 640 in the display device may be connected via a bus or by other means, and in FIG. 6, a connection via the bus is taken as an example.

The input device 630 may receive numeric or character information input, and the output device 640 may include the display device such as a display screen.

The memory 620 is taken as a computer readable storage medium that may be configured to store software programs, computer executable programs, and modules. The processor 610 performs various functional applications and data processing by running the software programs, instructions, and modules stored in the memory 620, to implement any method of the above embodiments.

The memory 620 may include a program storage area and a data storage area, wherein the program storage area may store an operating system, an application program required by at least one function; and the data storage area may store data or the like created according to the use of the display device. In addition, that memory may include a volatile memory such as a random access memory (RAM) and may also include a non-volatile memory, such as at least one disk storage device, a flash memory device, or other non-transitory solid state storage device.

The memory 620 may be a non-transitory computer storage medium or a transitory computer storage medium. The non-transitory computer storage medium, such as at least one disk storage device, a flash memory device, or other non-volatile solid state storage device. In some embodiments, the memory 620 may optionally include a memory remotely disposed with respect to the processor 610, which may be connected to the display device via a network. Examples of the above network may include the Internet, an intranet, a local area network, a mobile communication network, and combinations thereof.

The input device 630 may be configured to receive the numeric or character information input and to generate key signal inputs related to user settings and function control for the display device. The output device 640 may include a display device such as a display screen.

The display device of the present embodiment may further include a communication device 650 for transmitting and/or receiving information through a communication network.

A person skilled in the art should understand that the processes of the methods in the above embodiments can be, in all or in part, implemented by computer programs instructing related hardware. The programs can be stored in a non-transitory computer readable storage medium. When the programs are executed, the process of the embodiments of the above method may be included. The non-transitory readable storage medium may be a magnetic disk, an optical disk, and a read-only memory (ROM) or a random access memory (RAM) and the like.

What is claimed is:

1. A driving method for a display device, a frame of an original display image of the display device comprising at least one area, each area comprising a plurality of pixels, and the driving method comprising:

dividing the frame of the original display image in one of the area into a first frame display image and a second frame display image; wherein each pixel in the original display image, the first frame display image, and the second frame display image comprises a component corresponding to a first color space, the component comprising a first component, a second component, and a third component;

obtaining a first average value, a second average value, and a third average value corresponding to the original display image in the area; wherein the first average value, the second average value, and the third average value are average values of the first component, the second component, and the third component corresponding to the original display image respectively, and the first average value is larger than the second average value, the second average value is larger than the third average value;

setting the average values of the first component, the second component, and the third component corresponding to the first frame display image in the area to be equal to the second average value, and setting the average values of both the first component and the third component corresponding to the second frame display image to be equal to the third average value, and setting the average value of the second component corresponding to the second frame display image to be equal to zero;

adjusting lightness of a backlight module according to the average values of the first component, the second component, and the third component corresponding to the original display image, the first frame display image, and the second frame display image in the area respectively;

obtaining a driving component corresponding to the pixel in the second frame display image, according to the lightness of the backlight module before and after adjustment, the component corresponding to the pixel in the original display image, and the driving component corresponding to the pixel in the first frame display image corresponding to the area; wherein the driving component corresponding to the pixel in the first frame display image is equal to a secondary largest component corresponding to the pixel in the original display image;

obtaining a hue angle value and a saturation in a second color space according to the first average value, the second average value, and the third average value;

setting the lightness of the backlight module corresponding to a set component corresponding to the pixel in the second frame display image according to the hue angle value and the saturation; wherein the set component corresponds to the secondary largest component corresponding to the pixel in the original display image; and driving a pixel unit in the display device to display according to the driving component corresponding to the pixel in the first frame display image and the driving component corresponding to the pixel in the second frame display image in the area.

2. The driving method according to claim 1, wherein after obtaining a driving component corresponding to the pixel in the second frame display image, according to the lightness of the backlight module before and after adjustment, the component corresponding to the pixel in the original display image, and the driving component corresponding to the pixel in the first frame display image corresponding to the area, the method further comprises:

determining a relationship between the obtained driving component corresponding to the pixel in the second frame display image in the area with zero and with the first component corresponding to the pixel in the original display image;

setting the driving component corresponding to the pixel in the second frame display image to be equal to zero, when the obtained driving component corresponding to the pixel in the second frame display image is smaller than zero; and setting the driving component corresponding to the pixel in the second frame display image to be equal to a maximum component corresponding to the pixel, when the obtained driving component corresponding to the pixel in the second frame display image is larger than the maximum component corresponding to the pixel.

3. The driving method according to claim 1, wherein the backlight module comprises a first backlight module, a second backlight module and a third backlight module, and the adjusting the lightness of a backlight module according to the average values of the first component, the second component, and the third component corresponding to the original display image, the first frame display image, and the second frame display image in the area respectively comprises:

adjusting the lightness of the first backlight module according to a grayscale lightness value of the average value of the first component corresponding to the original display image, the first frame display image, and the second frame display image in the area respectively;

adjusting the lightness of the second backlight module according to the grayscale lightness value of the average value of the second component corresponding to the original display image, the first frame display image, and the second frame display image in the area respectively; and adjusting the lightness of the third backlight module according to the grayscale lightness value of the average value of the third component corresponding to the original display image, the first frame display image, and the second frame display image in the area respectively.

4. The driving method according to claim 1, wherein the backlight module comprises a first backlight module, a second backlight module and a third backlight module, wherein the obtaining a driving component corresponding to the pixel in the second frame display image, according to the lightness of the backlight module before and after adjustment, the component corresponding to the pixel in the original display image, and the driving component corresponding to the pixel in the first frame display image corresponding to the area comprises:

obtaining the driving component corresponding to the first component of the pixel in the second frame display image according to the lightness of the first backlight module before and after adjustment, the first component corresponding to the pixel in the original display image, and the driving component corresponding to the pixel in the first frame display image corresponding to the area;

obtaining the driving component corresponding to the second component of the pixel in the second frame display image according to the lightness of the second backlight module before and after adjustment, the second component corresponding to the pixel in the original display image, and the driving component corresponding to the pixel in the first frame display image corresponding to the area; and obtaining the driving component corresponding to the third component of the pixel in the second frame display image according to the lightness of the third backlight module before and after adjustment, the third component corresponding to the pixel in the original display image, and the driving component corresponding to the pixel in the first frame display image corresponding to the area.

5. The driving method according to claim 1, wherein the first color space is a red, green, and blue, RGB color space.

6. The driving method according to claim 5, wherein the first component, the second component and the third component of the first color space correspond to a red component, a green component and a blue component in the RGB color space respectively.

7. The driving method according to claim 1, wherein the second color space is an LCH color space.

8. The driving method according to claim 1, wherein the display device is a liquid crystal display device.

9. A computer readable storage medium, having computer executable instructions stored thereon, wherein, any method of claim 1 is implemented when the computer executable instructions are executed.

10. A driving method for a display device, a frame of an original display image of the display device comprising at least one area, each area comprising a plurality of pixels, and the driving method comprising:

dividing the frame of the original display image in one of the area into a first frame display image and a second frame display image; wherein each pixel in the original display image, the first frame display image, and the second frame display image comprises a component corresponding to a first color space, the component comprising a first component, a second component, and a third component;

obtaining a first average value, a second average value, and a third average value corresponding to the original display image; wherein the first average value, the second average value, and the third average value are the average values of the first component, the second component, and the third component corresponding to the original display image respectively, and the first average value is larger than the second average value, the second average value is larger than the third average value;

setting the average values of the first component, the second component, and the third component corresponding to the first frame display image in the area to be equal to the second average value, and setting the average values of both the first component and the third component corresponding to the second frame display image to be equal to the third average value, and setting the average value of the second component corresponding to the second frame display image to be equal to zero;

adjusting lightness of the first backlight module according to a grayscale lightness value of the average value of the first component corresponding to the original display image, the first frame display image, and the second frame display image in the area respectively; adjusting the lightness of the second backlight module according to the grayscale lightness value of the average value of the second component corresponding to the original display image, the first frame display image, and the second frame display image in the area respectively; adjusting the lightness of the third backlight module according to the grayscale lightness value of the average value of the third component corresponding to the original display image, the first frame display image, and the second frame display image in the area respectively;

obtaining a driving component corresponding to the first component of the pixel in the second frame display image according to the lightness of the first backlight module before and after adjustment, the first component corresponding to the pixel in the original display image, and the driving component corresponding to the pixel in the first frame display image corresponding to the area; obtaining the driving component corresponding to the second component of the pixel in the second frame display image according to the lightness of the second backlight module before and after adjustment, the second component corresponding to the pixel in the original display image, and the driving component corresponding to the pixel in the first frame display image corresponding to the area; obtaining the driving component corresponding to the third component of the pixel in the second frame display image according to the lightness of the third backlight module before and after adjustment, the third component corresponding to the pixel in the original display image, and the driving component corresponding to the pixel in the first frame display image corresponding to the area; wherein the driving components corresponding to the first component, the second component and the third component of the pixel in the first frame display image are all equal to a secondary largest component corresponding to the pixel in the original display image;

obtaining a hue angle value and a saturation in a second color space according to the first average value, the second average value, and the third average value;

setting the lightness of the backlight module corresponding to a set component corresponding to the pixel in the second frame display image according to the hue angle value and the saturation; wherein the set component corresponds to the secondary largest component corresponding to the pixel in the original display image; and driving a pixel unit in the display device according to the driving component of the first component, the second component, and the third component of the corresponding pixel in the first frame display image and the driving component of the first component, the second component, and the third component of the corresponding pixel in the second frame display image in the area.

11. The driving method according to claim 10, wherein the first color space is a red, green, and blue, RGB color space.

12. The driving method according to claim 10, wherein the second color space is an LCH color space.

* * * * *